US005538204A

United States Patent [19]

Corbella

[11] Patent Number: 5,538,204

[45] Date of Patent: Jul. 23, 1996

[54] THREE SAIL KITE

[76] Inventor: Joseph R. Corbella, 6267 Charing St., San Diego, Calif. 92117

[21] Appl. No.: 389,891

[22] Filed: Feb. 15, 1995

[51] Int. Cl.[6] ..... B64C 39/06

[52] U.S. Cl. ..... 244/153 R

[58] Field of Search ..... 244/153 R, 155 A

[56] References Cited

U.S. PATENT DOCUMENTS

| | | | |
|---|---|---|---|
| 2,437,038 | 3/1948 | Nowka | 214/153 R |
| 3,894,704 | 7/1975 | Vincent | 244/153 R |
| 3,937,426 | 2/1976 | Pearce | 244/153 R |
| 5,120,006 | 6/1992 | Hadzicki | 244/155 A |
| 5,322,247 | 6/1994 | Munday et al. | 244/155 A |

FOREIGN PATENT DOCUMENTS

| | | | |
|---|---|---|---|
| 0401814 | 12/1990 | European Pat. Off. | 244/153 R |

*Primary Examiner*—Galen L. Barefoot
*Attorney, Agent, or Firm*—Baker, Maxham, Jester & Meador

[57] ABSTRACT

A multiple sail kite with improved control of its flight path by providing user control adjustments of the relative positions of the multiple sails. In the preferred embodiment left and right sails disposed adjacently along the common horizontal axis are both rotatable about the common axis. A center sail is disposed behind the left and right sails and connected thereto. Four control lines provide the user with means to rotate the left and right sails in desired manner to produce a wide variety of flight maneuvers.

21 Claims, 6 Drawing Sheets

THREE SAIL KITE

BACKGROUND OF THE INVENTION

1. Technical Field

The present invention relates to kites and more particularly to a multiple sailed kite with improved control of its flight path by providing user controlled adjustments of the relative position of the multiple sails.

2. Discussion

Since the invention of the first kite, kite flyers have continually developed new kite designs in an effort to improve the flying capabilities of kites. Because of the infinite variability of wind conditions, a kite design which flies well in some conditions may not perform well or at all in others. Ideally, a kite will fly in a stable manner in varying wind conditions, will have good lift and will provide the kite flyer with a good control of the flight of the kite to perform various maneuvers. In an effort to achieve the goal of a kite with superior aerodynamic flight characteristics many different kite designs have been developed. These generally fall into the category of single sail or multiple sail kites. Also, in order to provide the kite flyer with an additional degree of control both of these types of kites may employ multiple control lines instead of the usual single control line.

The ubiquitous single sail kite with a single control line is still very popular. However, single sail kites having multiple control lines are becoming increasingly common and may be found, for example, in U.S. Pat. Nos. 2,839,259; 3,338,536; 3,746.286; 3,892,375; 3,335,129; and 2,388,478; 2,472,075; 3,086,739. By using multiple controls lines these kites provide additional control to the user by permitting the user to tilt the position of the kite in various ways.

Examples of dual sail kites, with single control lines are found in U.S. Pat. Nos. 3,194,520 and 3,296,617. Also, dual sailed kites having multiple control lines include U.S. Pat. Nos. 2,437,038 and 4,286,762. In addition, kites have been developed which employ more than two sails, such as the kite in U.S. Pat. No. 2,546,,078. Other designs which have appeared to improve flight characteristics include the flexible wing kites found in U.S. Pat. Nos. 2,751,172 and 2,546,078; and the inflatable kites, for example, in U.S. Pat. Nos. 4,129,272 and 3,952,975.

Despite all of these various designs, the ideal kite design has not yet been achieved. Kite flyers continue to search for improvements due to various disadvantages with all of these designs, since they all have their own strengths and weaknesses in varying wind conditions.

Thus, it would be desirable to provide an improved kite which exhibits superior aerodynamic flight characteristics. Such a kite would exhibit superior stability and lift and afford the user a greater degree of control. That is, the user would be able to achieve an improved degree of control in executing a variety of flight patterns and maneuvers such a spins, left and right turns, speed control, reverse flight, etc. Furthermore, it would be desirable to provide these features in a kite which has a relatively simple design and which is collapsible for ease of portability.

SUMMARY OF THE INVENTION

Pursuant to the present invention an improved multiple sail kite is provided which affords the user a greater degree of control than was heretofore possible. This is possible because the kite of the present invention utilizes a unique configuration of sails giving the user more than one angle (plane) of wind deflection around its sails when in a neutral position.

In accordance with a first embodiment of the present invention a multiple sail kite includes left and right sails disposed adjacently along a common horizonal axis. The left and right sails are both rotatable about the common axis. Further, a center sail is disposed behind the left and right sails. Also, a control means is connected to the left and right sails for permitting a user to rotate the left and right sails about the common axis.

In accordance with another embodiment of the present invention a multiple sail kite includes left and right sails disposed adjacently along a common horizonal axis. The sails have substantially reduced area near the midpoint between the two sails along the axis as compared to the sail area at a point further away from this midpoint. The kite further includes a center sail disposed behind the left and right sails, the center sail being centered about said midpoint along the horizontal axis. As a result, the present invention provides a kite that has superior aerodynamic flight characteristics, is stable, has good lift, and affords the user a great deal of control of the flight pattern permitting a wide variety of flight maneuvers to be accomplished.

BRIEF DESCRIPTION OF THE DRAWINGS

The various advantages of the present invention will become apparent to one skilled in the art by reading the following specification and by reference to the following drawings in which.

DETAILED DESCRIPTION OF THE INVENTION

Figure 1:
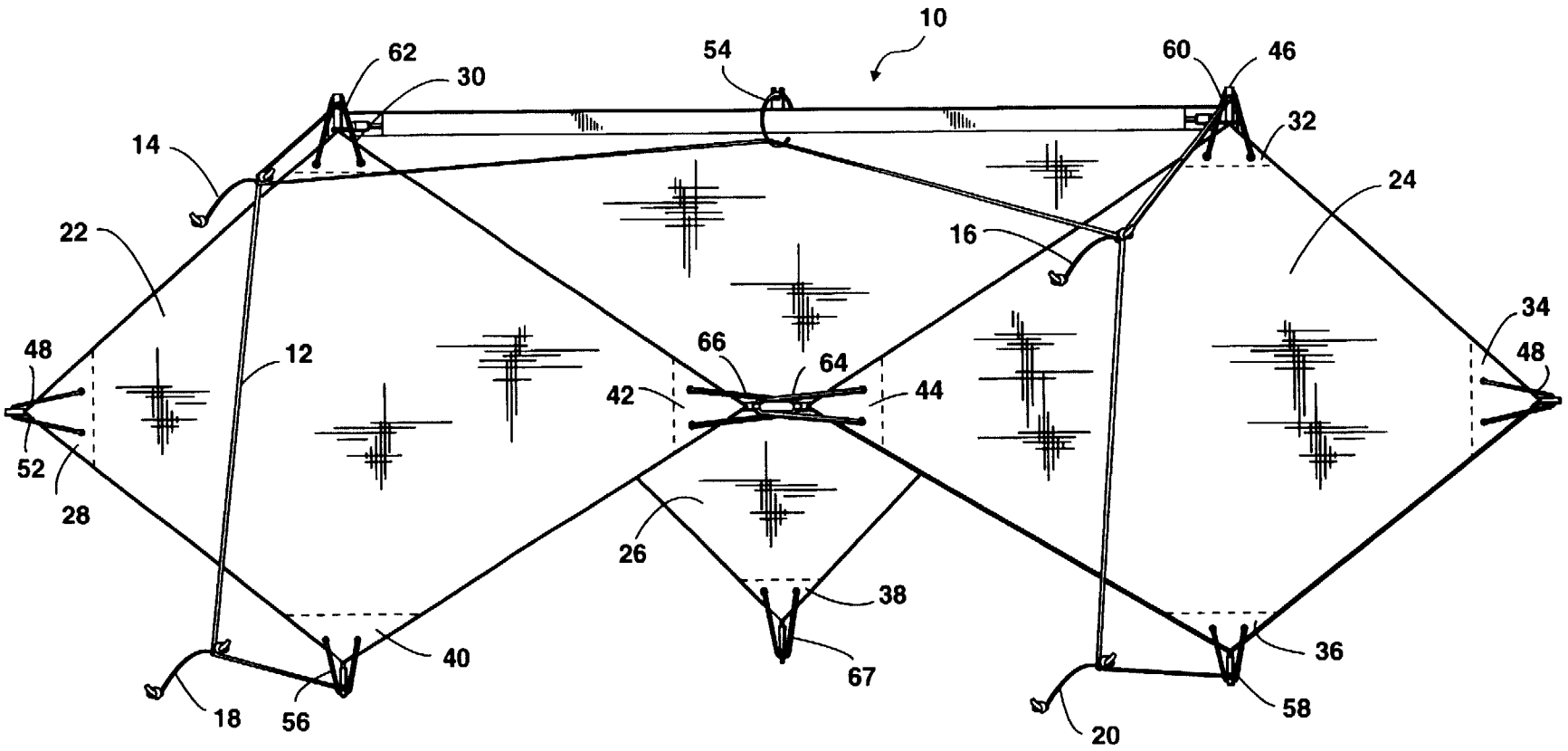
FIG. 1 is a diagram of a kite having three sails in accordance with a preferred embodiment of the present invention.
Figure 8:
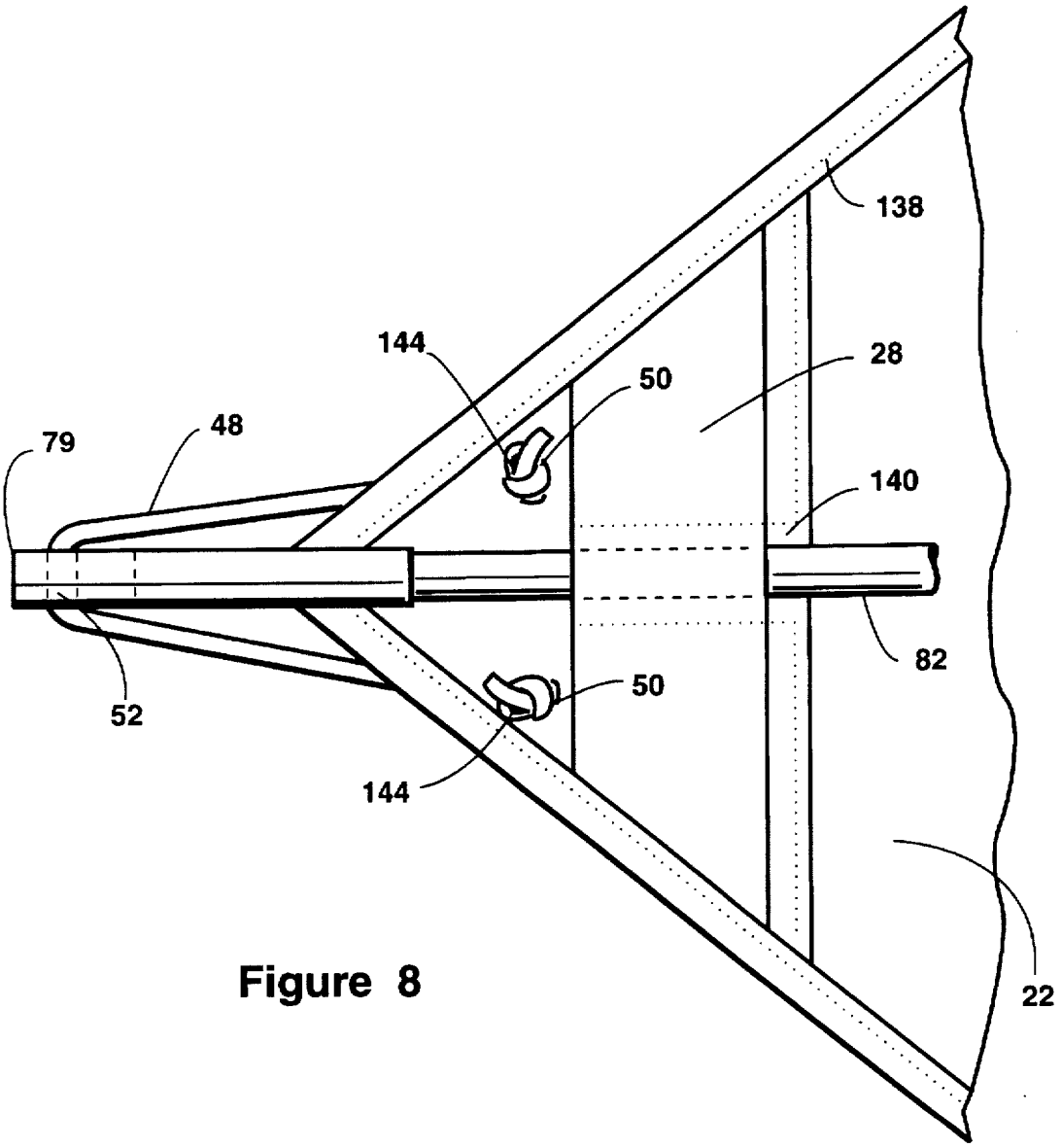
FIG. 8 is a diagram illustrating a back view of the Dacron reinforcing of the kite in accordance with the present invention.

Referring to FIG. 1 there is shown a kite in accordance with a preferred embodiment of the present invention. In this embodiment, the kite comprises three individual sails interconnected as shown. The kite 10 is shown including a bridle harness 12 having control points 14, 16, 18 and 20. A left sail 22 and a right sail 24 are disposed on a front sail plane. A center sail 26 is disposed behind the left and right sails. The left, right and center sail are all comprised primarily of a ripstop fabric which is commonly used in kites. At various stress points however, a different material such as resin-impregnated Dacron fabric is used for reinforcement. For example, such a Dacron reinforcing material is employed at the corners of the three sails at points designated with reference numerals 28, 30, 32, 34, 36, 38, 40, 42, and 44. Further details of the Dacron reinforcing material and its method of attachment is shown in FIG. 8 as discussed below.

On other sail corners, attachment to the frame structure 46 is by means of elastic cord loops 56, 58, 60, 62, 64, 66 and 68. As also shown in more detail in FIG. 5, elastic cords are attached to the sail through openings 50 in the sail and opening 52 in a member of the frame structure. The elastic cord loop 60 is secured at the opening 50 by knots. Elastic cord is used at these points to facilitate disassembly and assembly of the kite 10.

Figure 2:
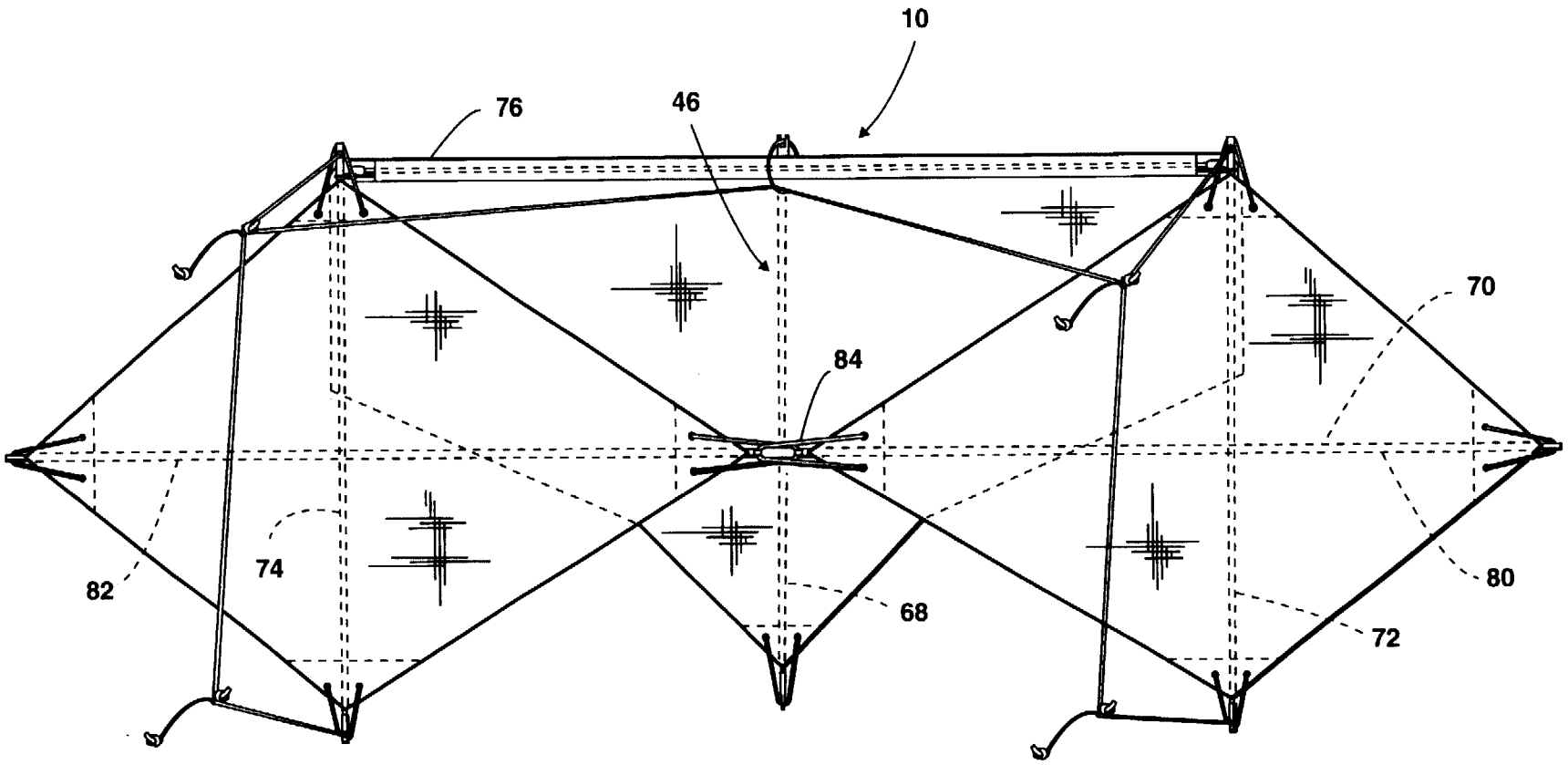
FIG. 2 is a diagram of a kite shown in FIG. 1 illustrating additional details in phantom view.

Referring now to FIG. 2 the kite 10 in accordance with the present invention in shown with the frame structure 46 visible in a phantom view illustrating its relationship to the three sails. Frame structure 46 includes a center spar 68, a main horizontal spar 70, a right vertical spar 72, a left vertical spar 74 and a top center spar 76. The frame structure 46 is also shown by itself in FIG. 3. From FIG. 3 it can be seen that main horizontal spar 70 has a pair of end caps 79 disposed on each end which have holes 52 through which the rope loops 48 and 48 are passed. Main horizontal spar 70 is comprised of a right horizontal spar member 80 and a left horizontal member 82. Left and right horizontal spar members 80 and 82 are joined by a central connector 84 as shown in more detail in FIG. 6.

Figure 6:
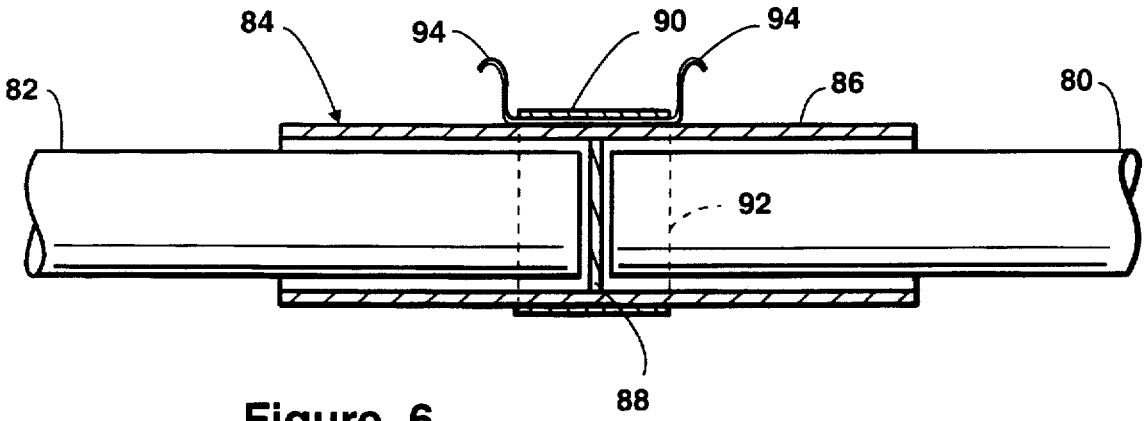
FIG. 6 is a sectional view of a center connector permitting pivoting motion of the left and right sails.

Referring now to FIG. 6 central connector 84 is comprised of a tubular member 86 with a center stop 88 disposed inside at its center. Tubular member 86 is preferably made of aluminum tubing. Tubular member 86 has an inside diameter which is slightly larger than the outside diameter of left and right horizontal spar to permit the left and right horizonal spar to slide into the tubular member 86 up to the point of the center stop. Also, there is sufficient clearance between the tubular module 86 to permit the left and right spar members to rotate freely therein. All of the spar members including the main horizontal spar 70, center spar 68, right and left vertical spars 72, 74 and center sail top spar 76, are all preferably made of carbon graphite tubes which offer good stiffness to weight ratio. Center connector 86 also includes a metal clip 90 which is preferably made of stainless steal. The clip 90 includes a tubular portion 92 which fits around the tubular member 86 and having attached therein a pair of flanges 94. Flanges 94 provide a means of attachment of elastic cord loops 64 and 66 as shown in FIG. 1.

Referring again to FIG. 3, center spar 68 has a v-shaped 96 disposed at its bottom end. The purpose of this nock is to secure the elastic cord 67 in the center sail. Center spar 68 passes behind the central connector 84 but is not attached thereto. At its upper end, center spar 68 includes another v-shaped nook 98 which serves to secure the rope loop 54 in FIG. 1 in place. Center sail horizontal spar 76 passes through the rope loop 54 and is attached at each end to the right and left vertical spars 72, 74 respectively as shown in more detail in FIG. 9. Center sail horizontal spar 76 is formed of a carbon tube which is somewhat thinner and more flexible than the left and right vertical spars and the main horizontal spar. In fact it is desired that the center sail horizontal spar 76 be held in a curved configuration which is maintained by a Dacron line 100 attached to a pair of spar connectors 102 at each end to the center sail horizontal spar 76. Dacron line may be attached to the spar connectors 102 by means of a knot 104 at one end and a metal hook 106 at the other. It has been found that the bow shape of the center sail horizontal spar 76 which :results in a bowed contour for the center sail, improves the flight characteristics of the kite 10. In addition, this configuration adds structural strength to the frame structure 46.

Figure 5:
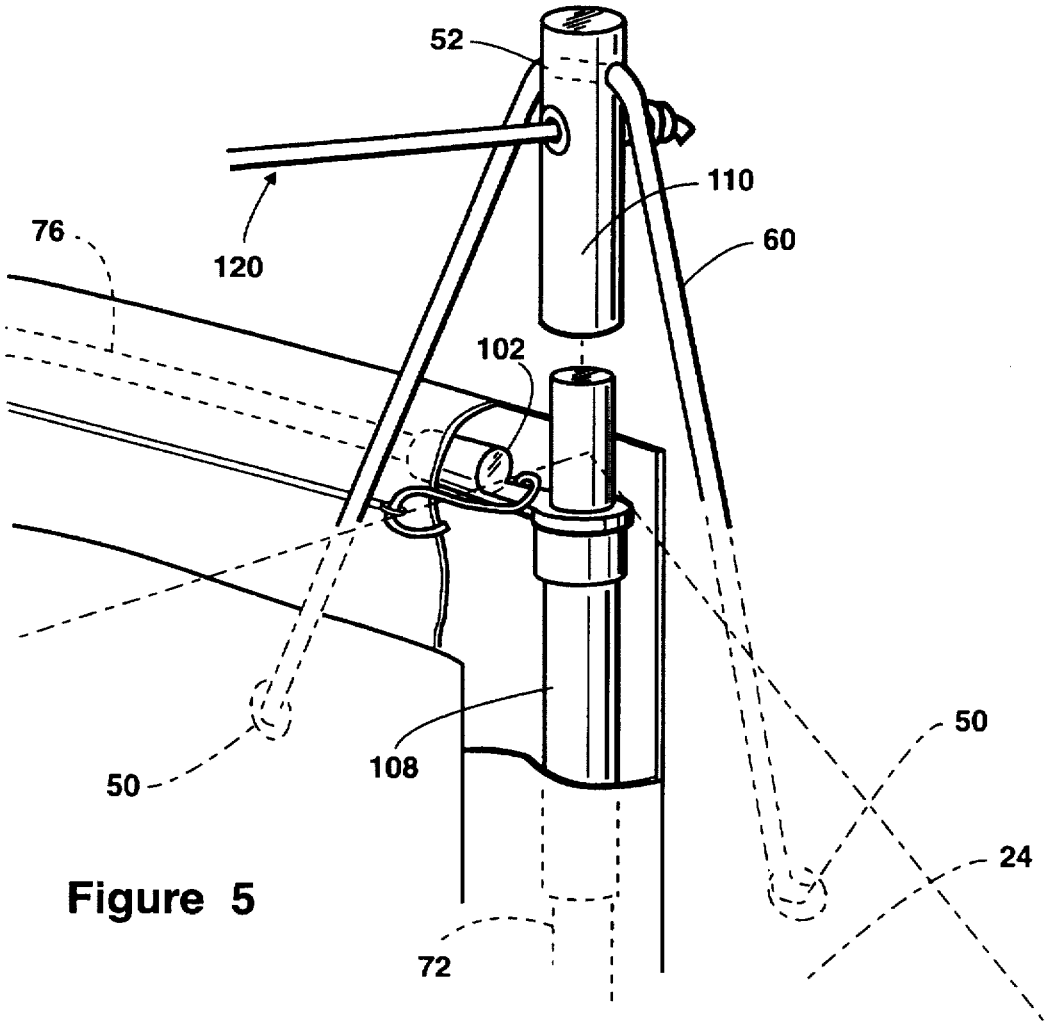
FIG. 5 is a sectional view of a corner of the kite of the present invention illustrating details of the construction of the kite.

Referring again to FIG. 3, the spar connectors 102 are shown to be looped through left and right vertical spar top connectors 108. Additional details of the left and right vertical spar connectors are shown in FIG. 5. At can be seen in FIG. 5, center sail horizontal spar 76 with end connector 102 is looped over the upper end of the right vertical right spar connector 108. Thereafter, right vertical spar cap 110 is inserted over the upper end of the right vertical spar connector 108. It will be appreciated that disassembly of the kite may be achieved by removing cap 110 thus permitting the center sail horizontal spar 76 to be removed by sliding the spar connector 102 off of right vertical spar connector 108. Also shown in FIG. 5 is elastic cord 60 which passes through opening 52 in the cap 110, also through openings 50 in the right sail 24.

Figure 7:
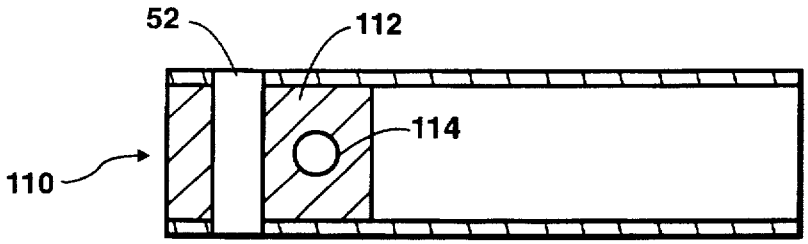
FIG. 7 is a diagram of the end cap construction in accordance with the preferred embodiment of the present invention.

Additional details of spar cap 110 are shown in FIG. 7. Spar cap 110 is preferably made of aluminum tubing having and inner diameter to permit the spar 72 to be removably inserted therein. A filler material 112 is disposed in the interior of the cap 110 to serve as a stop for the spar 72. Also, a hole 52 is provided for permitting passage of the elastic cord loop 60. In addition, another hole 114 is provided to provide an anchor for the bridle harness 12 as described in more detail below.

Referring again to FIG. 3, it can be seen that a similar vertical spar connector 108 is disposed on the top of the left vertical spar which secures the spar connector 102 and includes a spar cap 110 similar to the configuration shown in FIG. 5. Likewise, additional caps 78 are disposed at the bottom end of the left and right vertical spars which are the same as the one described in connection with FIG. 7.

Figure 3:
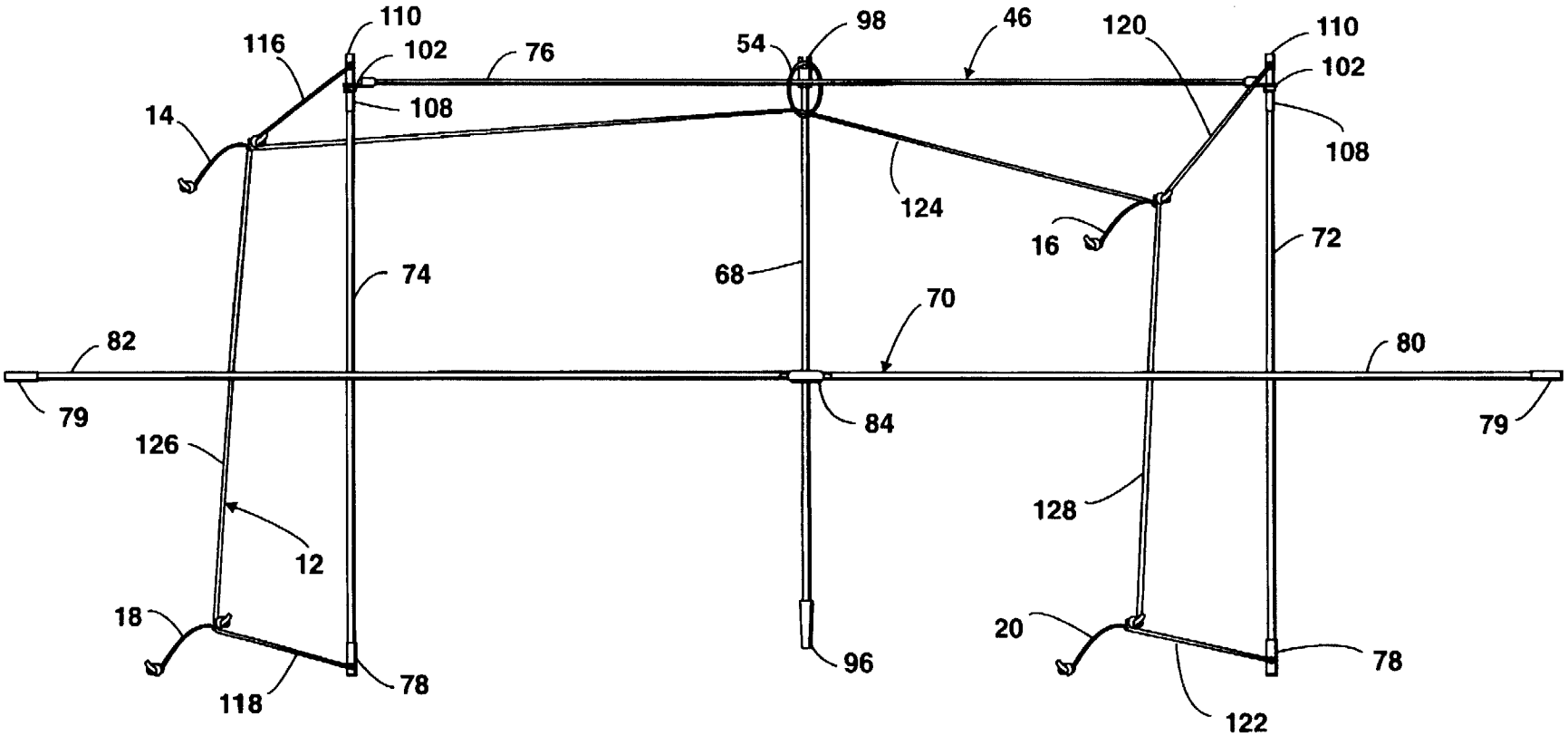
FIG. 3 is a diagram of the skeletal structure and harness bridle of the preferred embodiment of the kite in accordance with the present invention.

FIG. 3 shows additional details of the bridle harness 12. The bridle harness 12 includes upper left 116, lower left 118, upper right 120 and lower right 122 control support lines which are each attached to the respective end caps 110 or 78 in the left and right vertical spars by means of the hole 114 in these end caps as shown in FIG. 7. A horizontal bridle line 124 is connected to the upper left and upper right control support lines at the upper left and right control points respectively. In addition, the horizontal bridle support 124 also attaches to rope loop 54. Bridle harness 12 also includes left and right vertical bridle lines 126 and 128 which are connected to the upper left and lower left control points 14, 18 and the upper right 16 and lower right 20 control points respectively.

Connected to the bridle harness 12 are four individual control lines (not shown) which are connected to the bridle harness at the upper left, lower left, and upper right and lower right control points, (14, 16, 18 and 20) respectively.

These control lines are connected to a pair of handles (not shown). For example both of the left control points 14, 18 may be connected to a left handle and both of the right control lines are connected to a right handle. Four equal lines of Kevlar or Spectra fiber ranging from 50 to 150 feet are used to send the signals from handles to kite. The left and right handles may comprise, for example, handles such as the handles 22 shown in U.S. Pat. No. 3,746,286 which is incorporated herein by reference. It will be appreciated that many various kinds of handles may be employed for this purpose as are well known to those skilled in the art.

Referring now to FIG. 8, a back view of left sail 22 is shown. Dacron reinforcing member 28 is shown which is disposed near the corner of left sail 22. The method of construction of the left sail corner is illustrated in FIG. 8 by stitching 138 which shows that the edges of the sail 22 are folded and stitched as shown. Dacron reinforcing member 28 is also stitched into the corner of the sail 22 as shown, with an opening 140 for permitting the left main horizontal spar member 82 to pass through. Also shown in FIG. 8 is end cap 79, rope loop 48 and knots 144 at the end of the rope loops which pass through openings 50 in the sail. It can be seen that the Dacron reinforcing member 28 provides additional strength to the sail corner 22 to guard against tearing due to stresses imposed by the rope 48 and left main horizontal spar 82. A similar manner of constructions as shown in FIG. 8 is also used in right corner of sail 24.

Figure 4:
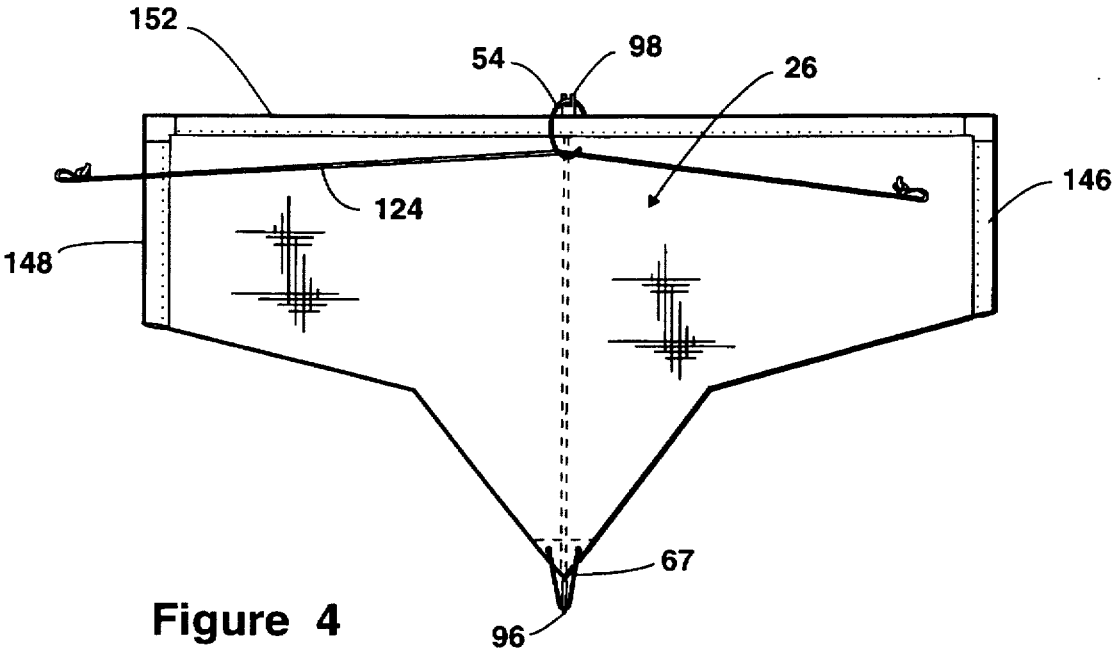
FIG. 4 is a diagram of the rear sail of the three sail kite in accordance with a preferred embodiment of the present invention.
Figure 9:
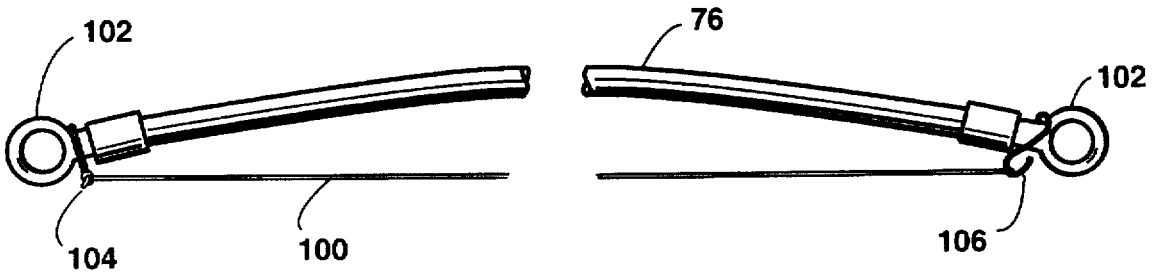
FIG. 9 is a diagram of the frame member and the structure for achieving a bow shape in the frame member of a preferred embodiment of the present invention.

Referring now to FIG. 4, the center sail 26 is shown. It can be seen that center sail 26 includes left and right sleeves 148, 146 formed by stitching a folded 2" wide Dacron material to the edge of the sail 26. As best seen by reference to FIG. 2, the left and right vertical spars 74, 72 pass through the sleeves 146, 148. In this way, the left and right sides of the center sail 26 are secured to be generally in the plane of the left and right sails. However, due to the bowed shape of the center sail horizontal spar 76, as shown in FIG. 9, the center region of the center sail adjacent to center spar 68 will be disposed somewhat displace from and behind the plane of the left and right sails 22, 24.

Likewise, center sail horizontal spar 76 is disposed in a sleeves 152 sown into the upper edge of center sail 26. This results in the upper edge of the center sail conforming in shape to the curved shape of the center sail horizontal spar 76 as shown in FIG. 9.

Referring again to FIG. 1, at the corners, the three sails are attached to a frame structure 46 by means of rope loops. For example, rope loop 48 passes through to openings 50 in the corner of the left sail and also passes through an opening 52 in a frame member forming part of the frame structure 46. Rope loop 48 is restrained from passing through openings 50 in the left sail by means of knots in the ends of the rope loop 48 as shown in more detail in FIG. 8. Additional rope loops rope loop 54 disposed on the center sail.

From the forgoing it can be seen that the method of construction of the three sailed kite 10 is conducive to easy disassembly and assembly for superior portability. For example to disassemble the kite, elastic loops 64, 66 are removed from the metal clips 94. Likewise, rope loop 54 and elastic loop 67 are removed from the nock inserts 96 and 98. Further, end caps 110 and 78 are removed which permits removal of spars 72 and 74 and subsequent removal of rear sail 26. Additional disassembly is achieved by means of removing end caps 110, thereby separating the frame structure from the sails. As a result, the three sailed kite 10 of the present invention can be easily folded up to fit in a very compact space.

In operation, the kite user will hold the two handles (not shown). In this way, with the right hand the user will be able to control upper and lower right control points 516, 20 and with the left hand the user will be able to control upper and lower left control points 14, 18 via a 100 feet of flyline (not shown). In particular, by twisting the user's wrist, for example using the above discussed handle in U.S. Pat. No. 3,746,286, the user will be able to, in effect, lengthen upper control point 16 and shorten lower right control line 20. This will induce a pivoting motion in right sail 24 and right main horizontal spar 80 about the axis of the main horizontal spar. This pivoting motion results in turning of the right horizontal spar 80 within the center connector 84. In the preferred embodiment, this twisting motion is independent of the motion of left horizontal spar 82 which may at the same time remain motionless within the center connector 84.

It will be appreciated that it is within the scope of the present invention to also configure the kite 10 without pivoting motion in center connector, wherein the left and right horizontal spars 80, 82 do not move independently. However, in such a configuration all of the advantages of the preferred embodiment would not be achieved. It should also be noted that the center sail 26 will also have some motion induced as a result of the twisting motion of right sail 24. This is because of the connection between the center sail along a portion of right vertical spar 72. It is believed that this configuration creates a smoother transition of air displacement from the left and right sails to the center sail, which results in improved flight performance. That is, the smooth transition of complex air flow patterns from the left and right sails to the center sail, greatly enhance flight capabilities and stability. This also aids in lifting and turning effects.

The above discussed pivoting motion (lengthening of upper right control line 16 and shortening of lower right control line 20) positions the right sail area to direct air flow differently than from a neutral posture. This will induce a turn or a spin to the flight of kite 10. Likewise, the opposite motion on the part of the user (shortening upper right control line 16 and lengthening lower right control line 20) will result in a pivoting motion of the right sail that tends to lower the right sail with respect to the left sail and thereby induce a turn or a spin in the other direction.

Similarly, controlling the upper left and lower left control lines 14, 18 will result in a twisting motion of the left sail 22 to create desired flight patterns. Also, simultaneous adjustment of the left and right control lines can be used to create additional flight patterns. For example, if both left and right sails are rotated by effectively lengthening upper control lines the entire kite will tend to raise and achieve forward notion, the opposite effect will tend to lower or stop the entire kite. Holding both handles evenly with top control lines slightly shortened will produce a hovering type flight. Now, by pushing one handle slowly away from your body, a horizontal flight (a slide) will be achieved.

It has been found that the curvature of the center sail upper spar 76 is important to improving stability and efficiency in structural strength. Furthermore, the curvature on the rear sail gives the user the ability to launch or re-launch, the kite from any position on the ground with a simple tug on the flylines. It will be appreciated that many variations on the basic kite design described above may be employed in accordance with the present invention. As previously mentioned, a nonpivoting main horizontal spar may be used. Likewise, left and right sails may be combined into a single sail having a similar shape. Further, center sail 26 may be modified in many ways while still accomplishing the aims of the present invention. It will also be appreciated that additional sails may be added to the present kite with various effects within the scope of the present invention. Those skilled in the art will appreciate that other advantages can be obtained from the use of this invention and that modification may be made without departing from the true spirit of the invention after studying the specification, drawings and following claims.

I claim:

1. A multiple sailed kite comprising:

left and right sails disposed adjacently along a common horizontal axis; said left and right sails being rotatable about said common axis; and center sail disposed behind said left and right sails.

2. The kite of claim 1 further comprising pivot means on said axis disposed between said left and right sails permitting said left and right sails to be individually rotatable about said common axis.

3. The kite of claim 1 further comprising left and right pairs of control lines connected to said left and right sales respectively, each pair of control lines including an upper line connected to an upper portion of one of said left or right sails, and a lower control line connected to a lower portion of one of said left or right sails, wherein the rotation of said left and right sails is controllable by adjustment of said control lines.

4. The kite of claim 1 wherein said left and right sails have substantially reduced sail area near the midpoint between the two sails along said axis as compared to the sail area at points further away from said midpoint.

5. The sail of claim 1 wherein said left and right sails are substantially diamond shaped.

6. The kite of claim 1 wherein said center sail has substantially more surface above said axis than below said axis.

7. The kite of claim 2 further comprising a frame containing vertical and horizontal frame members and wherein said center sail contains left and right edges attached to the left and right vertical frame members respectively and wherein said rotatable motion of said left and right ,members is transferred partially to said center sail.

8. The sail of claim 1 wherein said left and right sails each have four sides and said center sail has seven sides.

9. The sail of claim 1 wherein said left, right and center sails all have a v-shaped edge extending below said axis.

10. The kite of claim 1 wherein said third sail has a curved top leading edge.

11. A multiple-sailed kite comprising:

left and right sails adjacently disposed alone a common horizontal axis, said sails having substantially reduced sail areas around the midpoint between the two sails along said axis as compared to the sail area at points further away from said midpoint along said horizontal axis; and center sail disposed behind said left and right sails, said center sail being centered about said midpoint along said axis.

12. The kite of claim 11 wherein said left and right sails are substantially diamond shaped.

13. The kite of claim 11 wherein said center sail has substantially more surface area above said axis than below.

14. The kite of claim 11 further comprising a frame containing vertical and horizontal frame members and wherein said center sail contains left and right edges attached to the left and right vertical frame members sails respectively.

15. The of claim 14 wherein said center sail is curved concavidly such that its midpoint between said left and right edges is a maximum distance from the plane of said left and right sails and said edges contact said plane.

16. The sail of claim 11 wherein said left and right sails are rotatable about said horizontal axis.

17. The kite of claim 11 wherein said left and right sails each have four sides and said center sail has seven sides.

18. The kite of claim of 11 wherein said left, right and center sails all have a v-shaped edge extending below said axis.

19. The kite of claim 11 wherein further comprising left and right pairs of control lines connected to left and right sails respectively, each pair of control lines containing an upper line connected to an upper portion of one of said left or right sails, and a lower control line connected to a lower portion of one of said left or right sails, wherein the rotation of said left and right sails is controllable by adjustment of said control lines.

20. The kite of claim 10 wherein a spar is disposed along the curved top leading edge, the spar having end terminals with holes therethrough at each end.

21. The kite of claim 11 wherein at least a portion of the center sail is separated a distance behind the left and right sails.

* * * * *